US007101294B2

(12) United States Patent
Tucker, Sr.

(10) Patent No.: US 7,101,294 B2
(45) **Date of Patent: *Sep. 5, 2006**

(54) MULTI-COMPONENT LACROSSE STICK HEAD

(75) Inventor: Richard B. C. Tucker, Sr., Ruxton, MD (US)

(73) Assignee: STX, LLC, Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/084,009

(22) Filed: Mar. 21, 2005

(65) Prior Publication Data

US 2005/0187044 A1 Aug. 25, 2005

Related U.S. Application Data

(63) Continuation of application No. 10/166,684, filed on Jun. 12, 2002, now Pat. No. 6,910,976.

(60) Provisional application No. 60/300,618, filed on Jun. 26, 2001.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| 2,985,209 | A | 5/1961 | Novelo | |
| 3,507,495 | A * | 4/1970 | Fracalossi et al. | 473/513 |
| 3,507,498 | A | 4/1970 | Tucker et al. | |
| 3,822,062 | A | 7/1974 | Tucker et al. | |
| 4,034,984 | A | 7/1977 | Crawford et al. | |
| 4,097,046 | A | 6/1978 | Friant | |
| 4,128,239 | A | 12/1978 | Grenadier et al. | |
| 4,206,918 | A | 6/1980 | Lewis, Jr. | |
| D318,509 | S * | 7/1991 | Naumburg, Jr. | D21/724 |
| 5,048,843 | A | 9/1991 | Dorfi et al. | |
| 5,174,580 | A | 12/1992 | Pratt | |
| 5,269,532 | A | 12/1993 | Tucker et al. | |
| 5,566,947 | A | 10/1996 | Tucker et al. | |
| 5,951,504 | A * | 9/1999 | Iglesias et al. | 602/27 |
| 6,066,056 | A | 5/2000 | Morrow et al. | |
| 6,723,134 | B1 * | 4/2004 | Tucker, Sr. | 473/513 |
| 6,910,976 | B1 * | 6/2005 | Tucker, Sr. | 473/513 |

FOREIGN PATENT DOCUMENTS

GB 342045 10/1932

(Continued)

OTHER PUBLICATIONS

Great Atlantic Lacrosse Company Catalog, Oct. 2001.

*Primary Examiner*—Eugene Kim
*Assistant Examiner*—M. Chambers
(74) *Attorney, Agent, or Firm*—Pillsbury Winthrop Shaw Pittman LLP

(57) ABSTRACT

A multi-component lacrosse stick head, made of at least two materials, including a base lacrosse head structure of one material and one or more overlays made of one or more other materials strategically located on the base structure. The base structure and overlays provide particular performance characteristics for the lacrosse head. An embodiment of the invention includes a base lacrosse head structure, and at least one of a ball stop overlay, a sidewall overlay, an edge overlay, a thread opening overlay, and a scoop overlay. The overlays are affixed to the base lacrosse head structure by, for example, insert molding, over molding, reaction injection molding, spray application, rotational molding, dual extrusion, casting, or an interference fit.

23 Claims, 17 Drawing Sheets

FOREIGN PATENT DOCUMENTS

| | | |
|---|---|---|
| GB | 424742 | 2/1935 |
| GB | 1589596 | 7/1977 |
| GB | 1589598 | 7/1977 |
| WO | PCT/US02/20088 | 6/2002 |

* cited by examiner

MULTI-COMPONENT LACROSSE STICK HEAD

This application is a continuation of U.S. patent application Ser. No. 10/166,684, filed Jun. 12, 2002 now U.S. Pat. No. 6,910,976, which claims the benefit of U.S. Provisional Application No. 60/300,618 filed Jun. 26, 2001, both of which are herein incorporated by reference in their entirety.

BACKGROUND

1. Field of the Invention

The present invention relates generally to lacrosse sticks, and more particularly, to synthetic lacrosse stick heads having a base lacrosse head structure on which overlays are strategically placed to enhance various performance characteristics.

2. Background of the Invention

In 1970, the introduction of double-wall, synthetic lacrosse heads revolutionized the game of lacrosse. In comparison to the traditional wooden single-wall heads, the synthetic heads imparted a lightness, maneuverability, and flexibility never-before experienced by lacrosse players. These performance advantages greatly enhanced players' skills such as throwing, catching, cradling, and scooping, and brought the sport of lacrosse to new levels of speed and excitement.

FIG. 1 illustrates a conventional molded head lacrosse stick. As shown, lacrosse stick 100 comprises a handle 102 shown in dotted lines, and a double-wall synthetic head 104. Head 104 comprises a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As shown, handle 102 fits into and through juncture 106, and abuts stop member 114. A screw or other fastener placed through opening 107 secures handle 102 to head 104.

For traditionally-strung pockets (which have thongs and string instead of mesh), thongs (not shown) made of leather or synthetic material extend from upper thong holes 116 in transverse wall 112 to lower thong holes 118 in stop member 114. In some designs, such as the design shown in FIG. 1, upper thong holes 116 are located on tabs 117 of the scoop 112. On other designs, upper thong holes 116 are located directly on the scoop 112. FIG. 1 shows four pairs (116, 118) of thong holes that accept four thongs. To complete the pocket web, the thongs have nylon strings threaded around the thongs and string laced through string holes 120 in sidewalls 108 and 110, forming any number of diamonds (crosslacing). Finally, one or more throwing or shooting strings extend transversely between the upper portions of sidewalls 108 and 110, attaching to throwing string hole 124 and a string laced through string hole 122. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

In addition to traditionally-strung heads, some heads use mesh pockets or a combination of traditional and mesh stringing. In any case, the mesh or stringing is conventionally attached to the head through holes in the scoop, sidewalls, and stop members, or by tabs attached to the scoop, sidewalls, and stop members. These tabs can have openings through which mesh or stringing is threaded, or can be shaped (e.g., like a hook) to retain loops of the mesh or stringing.

As used herein, thread holes or thread openings refer to the openings that receive the various forms of pocket stringing, such as the holes in the scoop, sidewalls, and stop members, or the openings in tabs attached to the scoop, sidewalls, and stop members. The term "openings" should be construed broadly so as to encompass any hole or structure that retains the pocket stringing, including structures such as hooks. Also, as used herein, a pocket thread refers to any member, such as a thong, string, or mesh, that forms the pocket and/or attaches the pocket to the lacrosse head.

The traditional double-wall synthetic head is an injection-molded, monolithic structure. Examples of suitable synthetic materials well known in the art include nylon, urethane, and polycarbonate. When first introduced, these materials were clearly superior to wood, offering players improved handling and durability. For example, a lacrosse head constructed of DuPont™ ZYTEL ST 801 nylon resin is able to withstand the bending and harsh impacts inherent to competition far better than a traditional wooden stick. As another example, polycarbonate, though having a flexibility similar to wood, is more structurally durable than wood and much lighter and, therefore, easier to handle.

Although the synthetic materials afford significant performance advantages, the use of a single material in a monolithic head limits a manufacturer's ability to satisfy divergent performance characteristics. For example, an offensive player typically prefers a more flexible lacrosse head, better suited for passing, shooting, and severe bending, such as the bending encountered during face-offs and when scooping ground balls. Defensive players, on the other hand, prefer a strong, rigid lacrosse head for hard checking offensive players. With a monolithic head, the manufacturer must choose a material that serves both disparate purposes (flexibility and rigidity). Although the manufacturer can compensate somewhat for this performance tradeoff by using structural elements (e.g., increasing the thickness of the sidewalls), the practical result of the tradeoff is a lacrosse head that satisfies neither purpose optimally.

There are many examples of these types of tradeoffs in choosing a material for a monolithic lacrosse head. For example, in terms of the coefficient of friction of a material, players prefer that the underside of the scoop of the lacrosse head is smooth, so that the stick slides easily across the ground, enabling players to easily scoop up ground balls. However, on the top of the scoop adjacent to the pocket, players would typically prefer a higher coefficient of friction so that the scoop better grips the ball. This increased grip improves ball control (e.g., spin and direction) as the ball leaves the pocket during a throw and as the ball enters the pocket when receiving a thrown ball.

Another significant tradeoff pertains to the hardness of the lacrosse head. To provide the rigidity necessary to handle and protect the ball, and to provide the durability necessary to endure the severe impacts of the game, synthetic materials must possess a substantial degree of stiffness, strength, and abrasion resistance. A drawback to these characteristics is the frequent injuries inflicted upon other lacrosse players by impact with the hard lacrosse head. Often, a player has her fingers crushed between the lacrosse head of an opponent and the lacrosse stick handle that she is holding. In addition, throwing and checking with the lacrosse sticks regularly result in inadvertent or deliberate contact with players' faces, arms, and other body parts. This injury problem is a particular concern for the women's game, in which the players wear virtually no personal protective equipment (e.g., no helmets or padding), yet the lacrosse heads are made of the same materials used in the men's heads. Further, in the women's game, despite game rules designed to avoid stick contact with the body, inadvertent contact with body parts regularly occurs.

On a larger scale, this injury problem is detrimental to the sport's popularity, as many young players are discouraged by the pain of routine contact. To reduce injuries, manufacturers could choose a softer lacrosse head material. However, a softer lacrosse head leads to excessive flexing, poor recovery from flexing, and inadequate rigidity for ball protection and legal checking purposes.

In an effort to soften the hard monolithic heads, some designs, such as that disclosed in British Patent No. 424,742 to Muir, simply add soft materials to a hard (wooden) lacrosse head frame. The rubber sheath in Muir covers the lacrosse head frame but does not bond to the frame such that the components move in unison and provide the solid feel of a monolithic head.

Another example of a performance tradeoff concerns the rigidity of the lacrosse head frame in relation to the tightness of the pocket strings. With conventional monolithic lacrosse heads, the stiffer the material of the head, the less the head flexes or "gives" in response to tension on the pocket. As a result, the pocket in a women's lacrosse head can become excessively tight, such that impact with the ball causes a trampoline effect that makes the ball hard to catch and control. In essence, the pocket, strung on a rigid unforgiving frame, acts like the strings of a tennis racquet and rebounds the ball out of the pocket. This trampoline effect is especially troublesome for women's lacrosse sticks, which have shallower and more tightly strung pockets than men's lacrosse sticks. (According to United States lacrosse rules, the combined height of the sidewall and pocket of women's lacrosse stick cannot exceed 2½ inches, while the men's can be up to 4¼ inches, in effect allowing a standard 2½ inch ball to sag 2 inches below the men's sidewall.) Again, restricted to a monolithic head, a manufacturer could use a more flexible, dampening head material to reduce the trampoline effect. However, the more flexible the material, the less suitable the head is for accurate passing and shooting, and for protecting against ball-jarring hits.

Another example of a tradeoff in performance characteristics relates to areas of a lacrosse head that must satisfy needs significantly different from the principal concerns of rigidity and flexibility. For example, manufacturers typically add a separate ball stop to the stop area of a lacrosse head to help deaden incoming balls. Conventionally, this piece is made of highly compressible, energy-absorbing material, e.g., foam. This foam ball stop is typically applied to the lacrosse head with adhesive and serves to absorb the ball's impact with the hard lacrosse head and thereby improve ball control. With monolithic lacrosse heads, constructing the entire head of this foam is completely impractical because of its lack of strength and rigidity. Thus, due to the playing characteristics expected of a modem lacrosse head, manufacturers have been unable to produce a lacrosse head with a shock absorbing stop area without adding a separate ball stop.

As an additional drawback, the foam material of the ball stop tends to deteriorate and fall apart under normal use. Frequently, players compound the problem by picking at the foam and destroying its effectiveness. In addition, players also deliberately modify the ball stops to gain ball control advantages over the competition. By building up a ball stop, shaping it in a special way (e.g., sloped) or completely removing the ball stop and substituting a more favorable material or component shape, a player can create an area in which a ball can be wedged behind the stop area and in the pocket. A better design would reduce the problems associated with the ball stop deterioration, would deter players from modifying components of a lacrosse head to gain unfair advantages over competitors, and would lessen the need for game officials to police the rules conformance of competitors' sticks.

SUMMARY OF THE INVENTION

The present invention is a multi-component lacrosse stick head that solves the performance tradeoffs associated with the conventional monolithic lacrosse heads. A multi-component structure is made of at least two materials, each of which provides particular performance characteristics for the lacrosse head. The multi-component lacrosse stick head of the present invention includes one or more overlays strategically located on a base lacrosse head structure. Though not monolithic, the materials and components of the multi-component lacrosse stick head are strongly bonded such that they move in unison. Further, the individual materials of the multi-component construction satisfy specific, often divergent, performance criteria of the lacrosse head, e.g., rigidity versus cushioning and shock absorbing.

In an embodiment of the present invention, an exemplary lacrosse stick head includes a base lacrosse head structure, and at least one of a ball stop overlay, a sidewall overlay, an edge overlay, a thread opening or tab overlay, and a scoop overlay. The base lacrosse head structure functions as the main support member of the lacrosse head. The base lacrosse head structure is made of a single, preferably rigid, material that satisfies desired stiffness requirements and serves as the structure on which the remaining components are strategically placed to provide particular performance characteristics. The remaining components are preferably affixed to the base lacrosse head structure by, for example, insert molding, over molding, reaction injection molding, spray application, rotational molding, dual extrusion, casting, or an interference fit.

According to an aspect of the present invention, the ball stop overlay is formed on the ball stop of the base lacrosse head structure and is a durable, integral component that resists deterioration and alteration, yet still provides a cushioning area that enhances ball control.

According to an aspect of the present invention, the sidewall overlays provide a coefficient of friction between the inside face of the sidewalls and a lacrosse ball that is greater than the coefficient of friction between the base lacrosse head structure and the lacrosse ball. The greater coefficient of friction enhances ball control. The sidewall overlays also provide shock absorbing to deaden impacts by the lacrosse ball, thereby improving ball control.

According to an aspect of the present invention, the edge overlays are located on areas of the base lacrosse head structure that most often contact players' hands and other body parts. Typically, these areas include the top and bottom edges of the sidewalls. Preferably, the edge overlays are located on the top edge of the sidewalls, on the portions of the sidewalls nearest the scoop.

According to an aspect of the present invention, the thread opening overlays cover the thong and string openings in the base lacrosse head structure and provide a compressible surface against which the pocket strings or thongs can pull. The compressible surface dampens the sharp pulling of the pocket in response to a ball impact and eliminates the undesirable trampoline effect of the prior art.

According to an aspect of the present invention, the scoop overlay is located on the scoop of the base lacrosse head structure and enables a manufacturer or player to fine-tune the surface friction provided by the scoop. By comparison, conventional scoops are made of the same materials as the overall lacrosse stick head, and therefore offer minimal friction and little control over the ball. Indeed, players have typically tried to prevent a ball's traveling up the pocket and off the scoop by adding throwing or shooting strings that limit contact between the ball and scoop. With the present invention, instead of adding components to avoid ball and scoop contact, the scoop overlay refines the scoop surface and encourages contact with the ball to improve ball control. The increased surface friction of the scoop overlay enables a player to impart force and spin on a lacrosse ball as it travels off the scoop. As an additional benefit, in comparison to using throwing strings, the present invention allows the ball to travel farther up the pocket and off the scoop, thereby enhancing the whip effect of the lacrosse stick and increasing ball velocity.

By incorporating strategically located overlays into the base lacrosse head structure, the present invention provides specific performance advantages (e.g., safety cushioning) without sacrificing the desired nature of the underlying base lacrosse head structure. Thus, the present invention provides a lacrosse head that optimizes at least two disparate performance characteristics. By using different overlay materials, the present invention can optimize more than two disparate performance criteria.

Accordingly, an object of the invention is to provide a lacrosse stick head with components made of different materials, each component of which is strategically located to satisfy disparate performance characteristics for the head.

Another object of the present invention is to provide a lacrosse stick head having a base lacrosse head structure that provides performance characteristics, and having overlays affixed to the base lacrosse structure that provide other performance characteristics.

Another object of the present invention is to provide a lacrosse stick head that enhances ball control.

Another object of the present invention is to provide a lacrosse stick head that minimizes injuries due to impact with the head.

Another object of the present invention is to deter alteration of lacrosse stick heads, especially in the area of the ball stop.

These and other objects and advantages of the present invention are described in greater detail in the detailed description of the invention, and the appended drawings. Additional features and advantages of the invention will be set forth in the description that follows, will be apparent from the description, or may be learned by practicing the invention.

DETAILED DESCRIPTION OF THE INVENTION

The present invention is a multi-component lacrosse head in which each component is specifically located and made of material that satisfies certain performance requirements. Often, the performance requirements are functionally incompatible such that a single material is unable to provide all requirements. The multi-component lacrosse head includes a base lacrosse head structure of one material and one or more overlays made of one or more other materials strategically located on the base structure.

Figure 1:
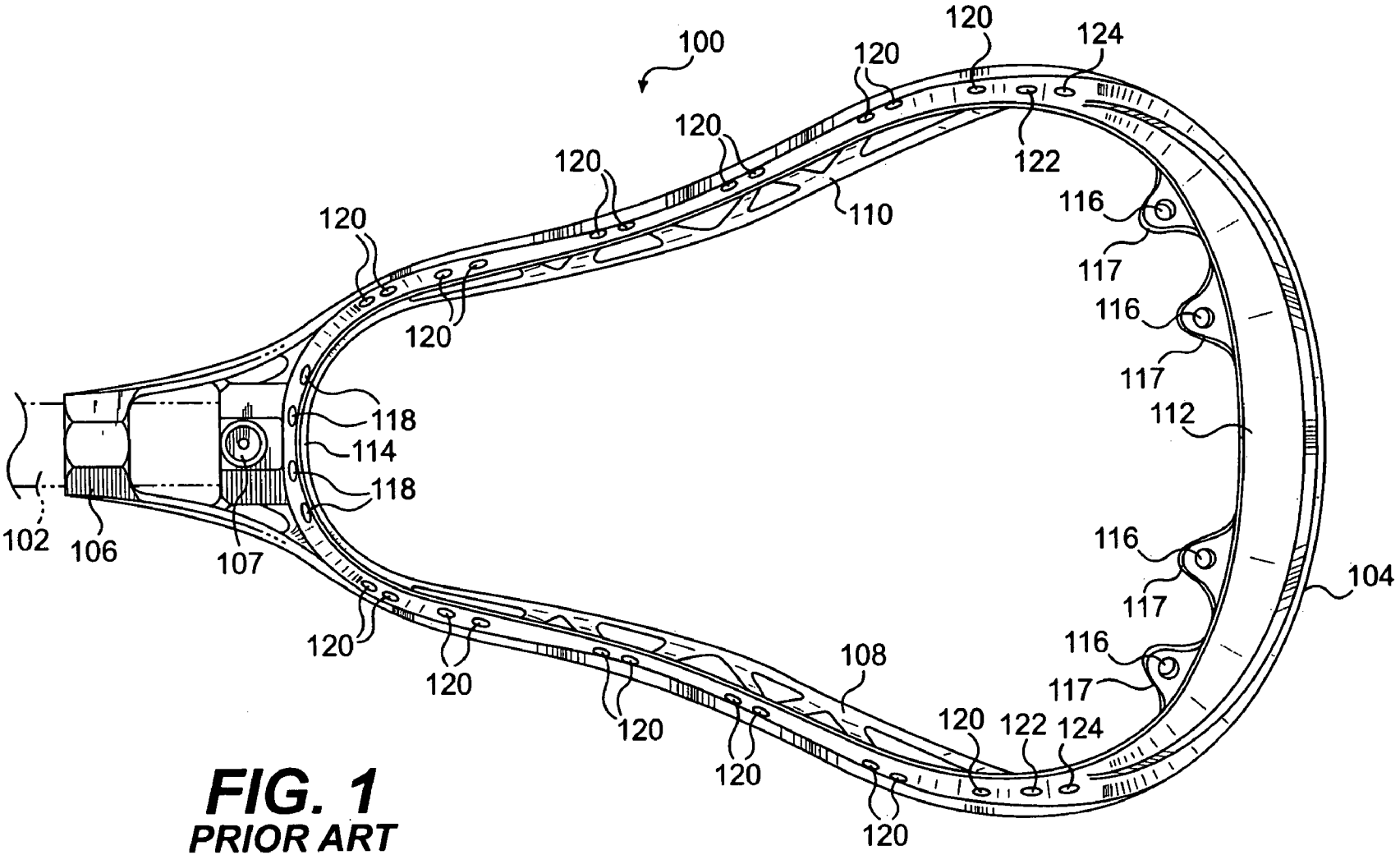
FIG. 1 PRIOR ART
FIG. 1 is a schematic diagram of a lacrosse stick.
Figure 2A:
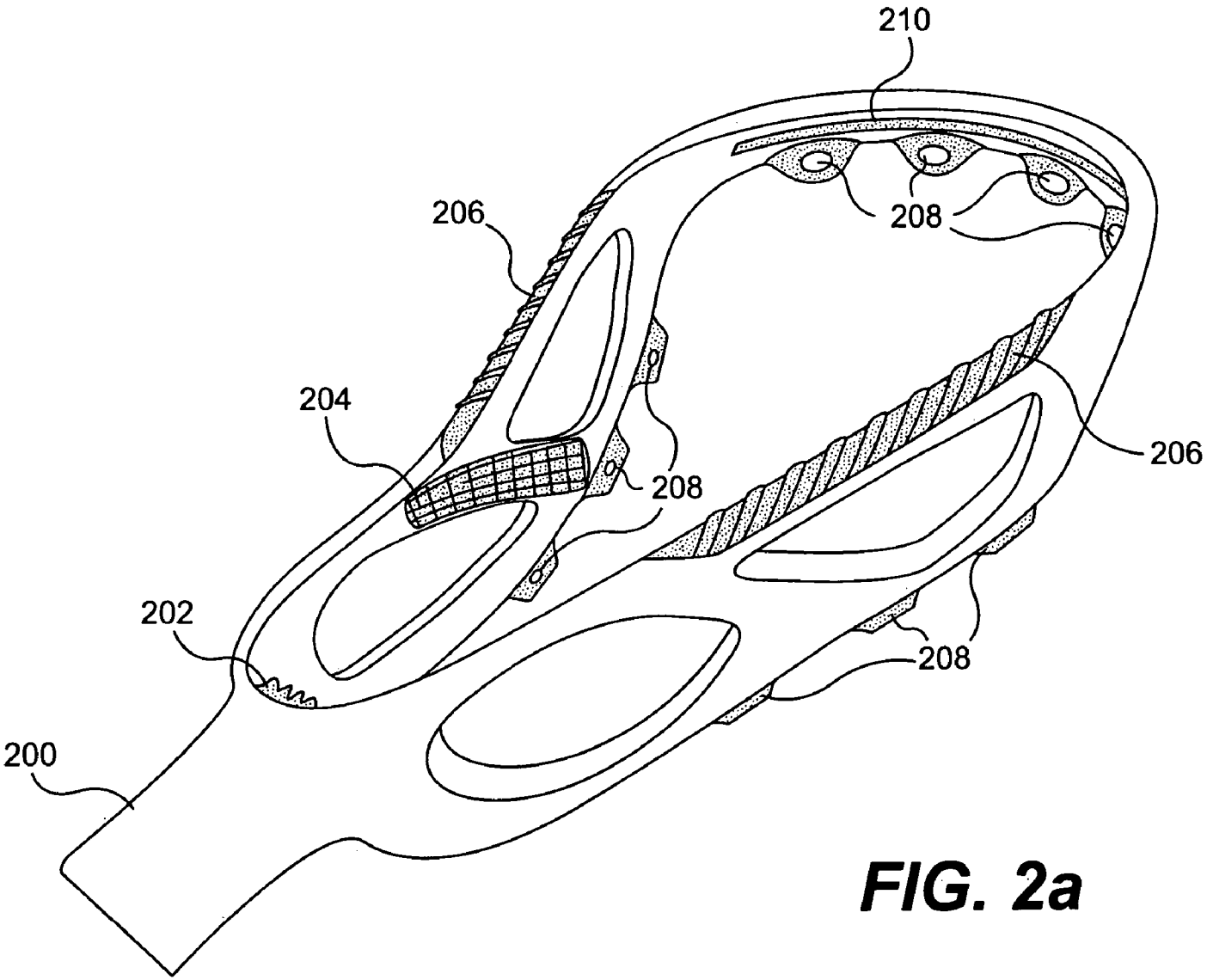
FIG. 2*a* is a schematic diagram of an exemplary lacrosse stick head, according to an embodiment of the present invention.
Figure 10:
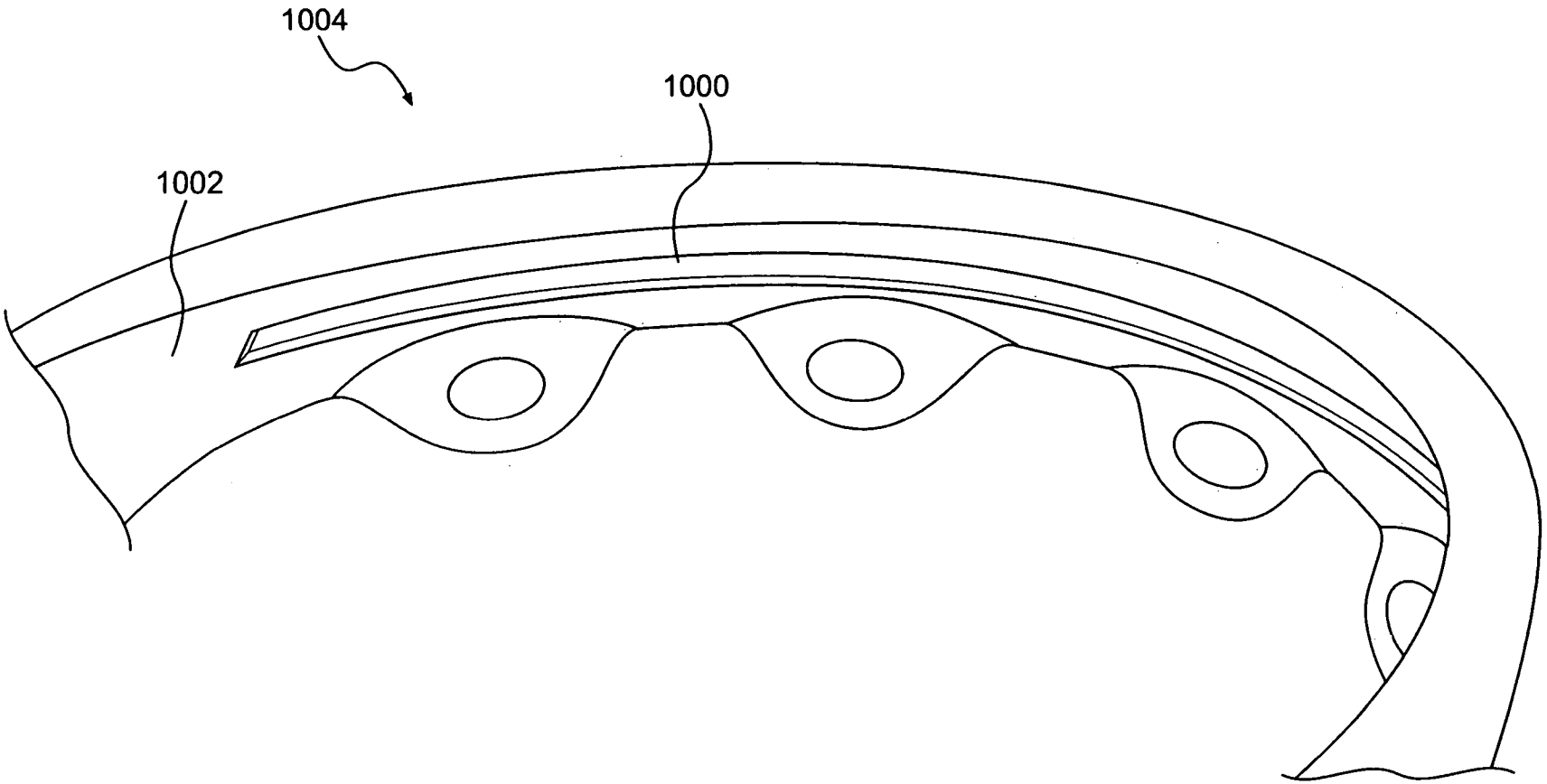
FIG. 10 is a schematic diagram of an exemplary lacrosse stick head having a recess in the scoop, according to an embodiment of the present invention.

Referring to FIG. 2*a*, an embodiment of the present invention includes a base lacrosse stick head 200, and at least one of a ball stop overlay 202, a sidewall overlay 204, an edge overlay 206, a thread opening overlay 208, and a scoop overlay 210. Base lacrosse stick head 200 has recesses or cavities to which the overlays are affixed by, for example, insert molding, over molding, reaction injection molding, spray application, rotational molding, dual extrusion, casting, or an interference fit. FIG. 10 illustrates an example of a recess 1000 disposed in a scoop 1002 of a base lacrosse head structure 1004.

Figure 11:
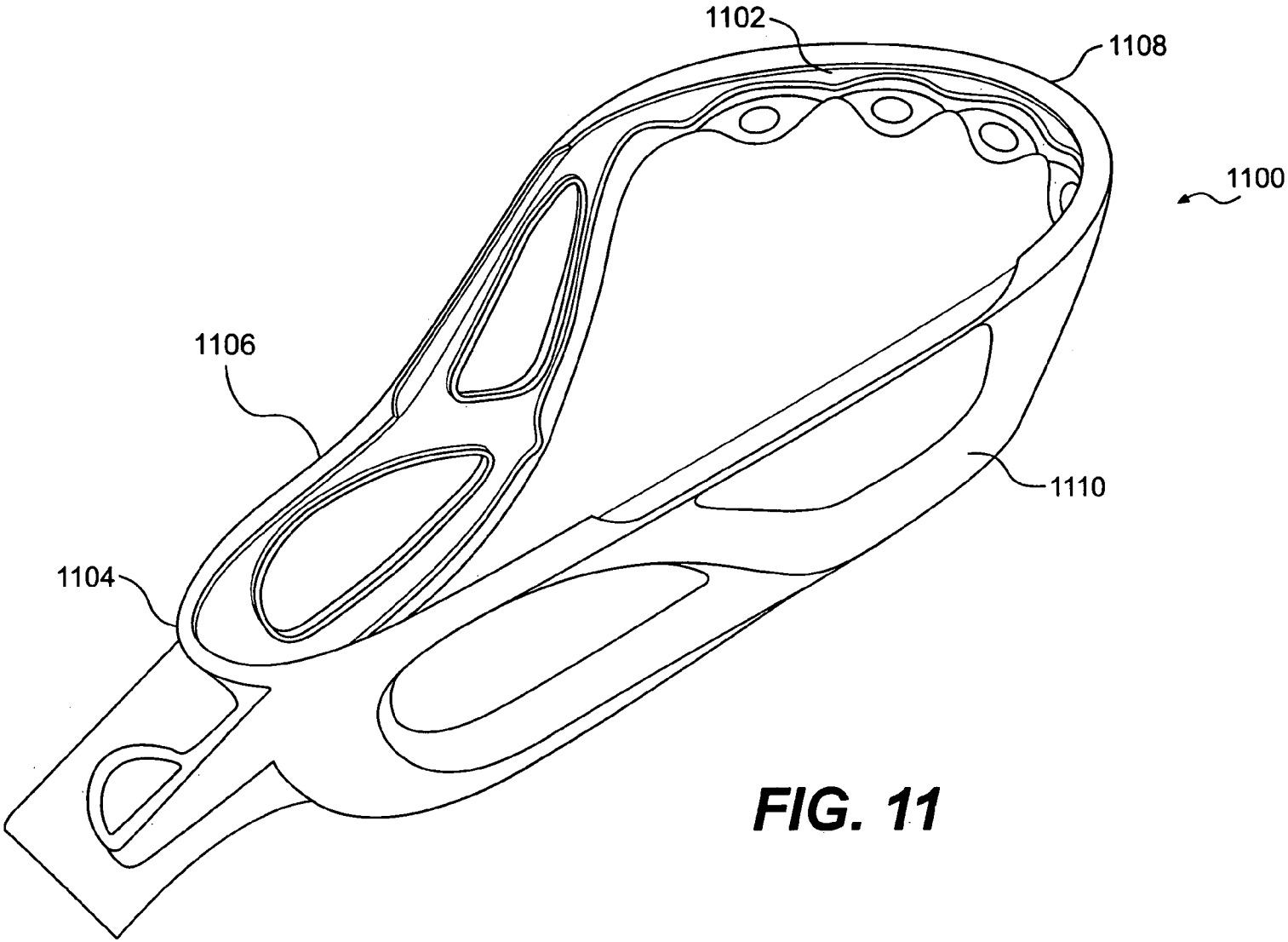
FIG. 11 is a schematic diagram of an exemplary lacrosse stick head having a continuous recess, according to an embodiment of the present invention.

FIGS. 3–7 depict various views of the components shown in FIG. 2*a,* with the exception of the tab thread opening overlays on the sidewalls. In addition, unlike FIG. 2*a,* in the exemplary lacrosse head of FIGS. 3–7, ball stop overlay 202, sidewall overlay 204, edge overlays 206, and scoop overlay 210 form one continuous overlay. FIG. 11 illustrates a base lacrosse head structure 1100 that includes a continuous recess 1102 for receiving a continuous overlay, from the stop member 1104 to the first sidewall 1106 to the scoop 1108 to the second sidewall 1110 and back to the stop member 1104.

Figure 3:
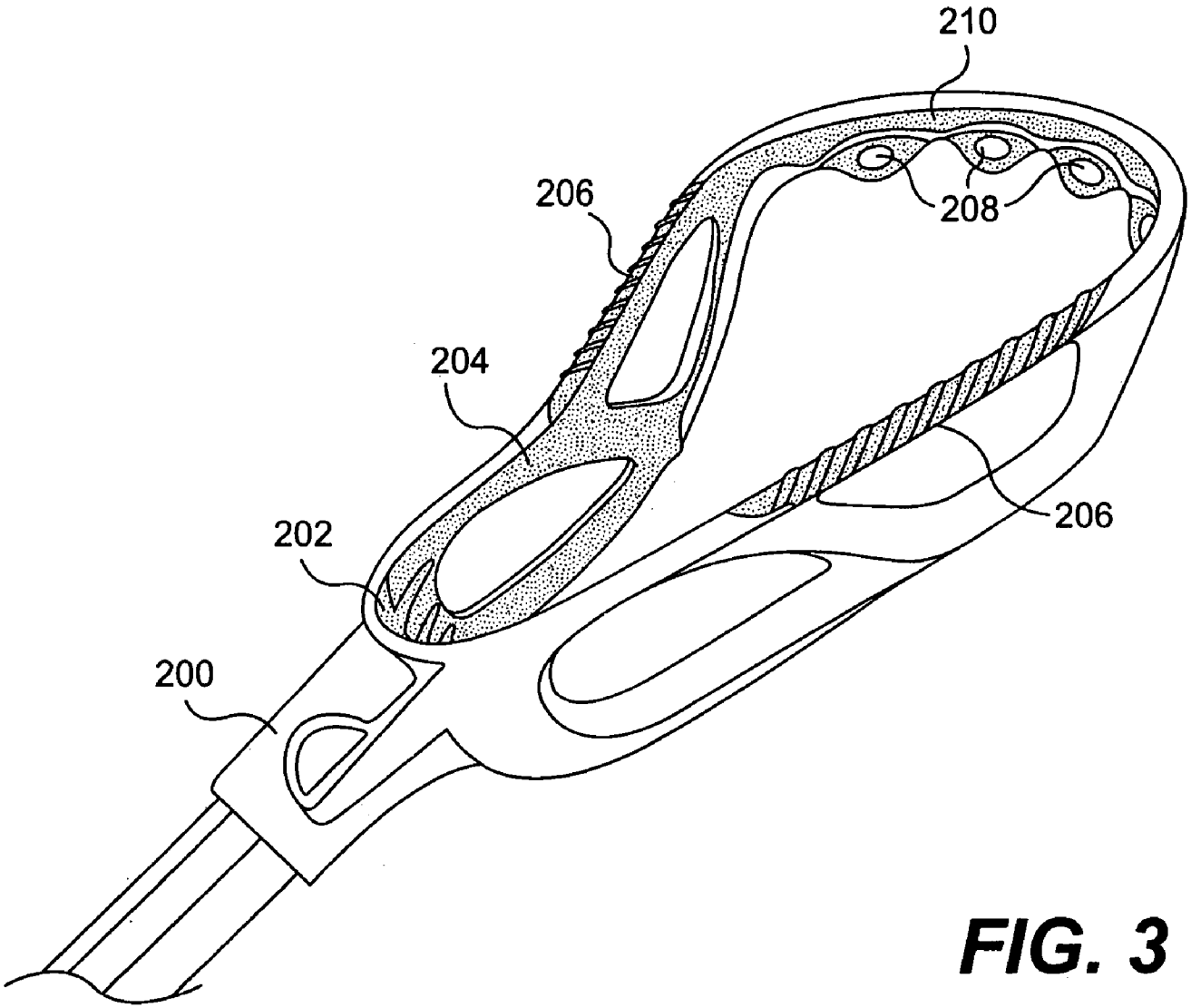
FIGS. 3–7 are schematic diagrams of an exemplary lacrosse stick head, according to an embodiment of the present invention.
Figure 4:
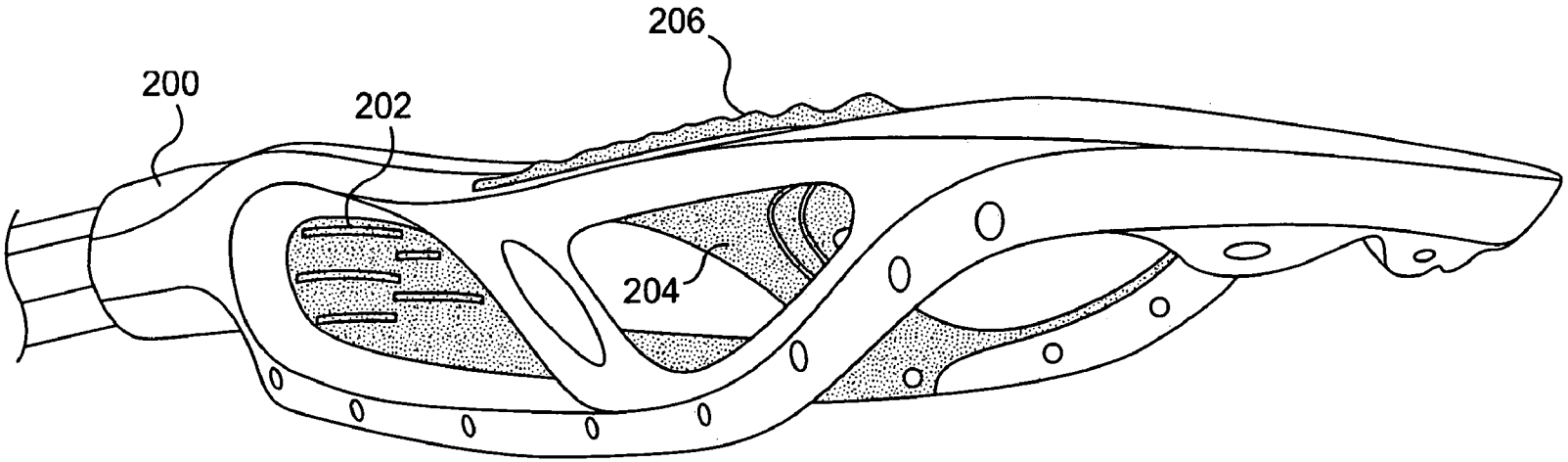
Figure 5:
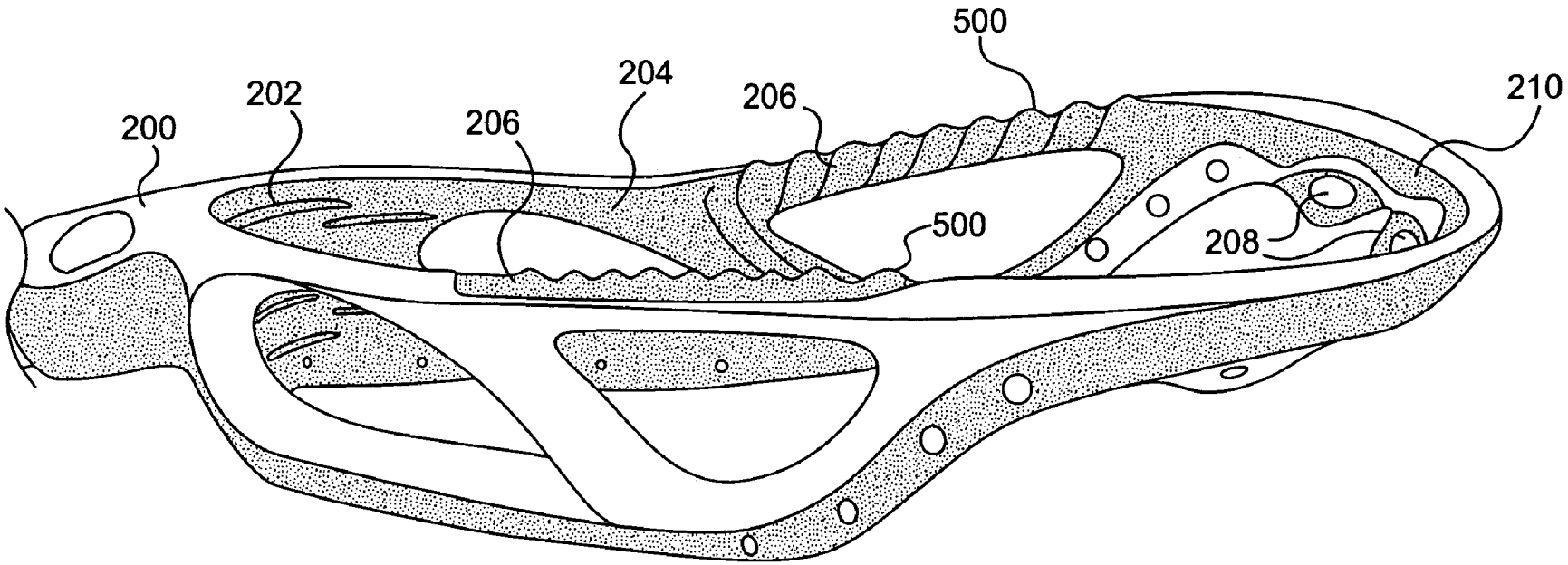
Figure 6:
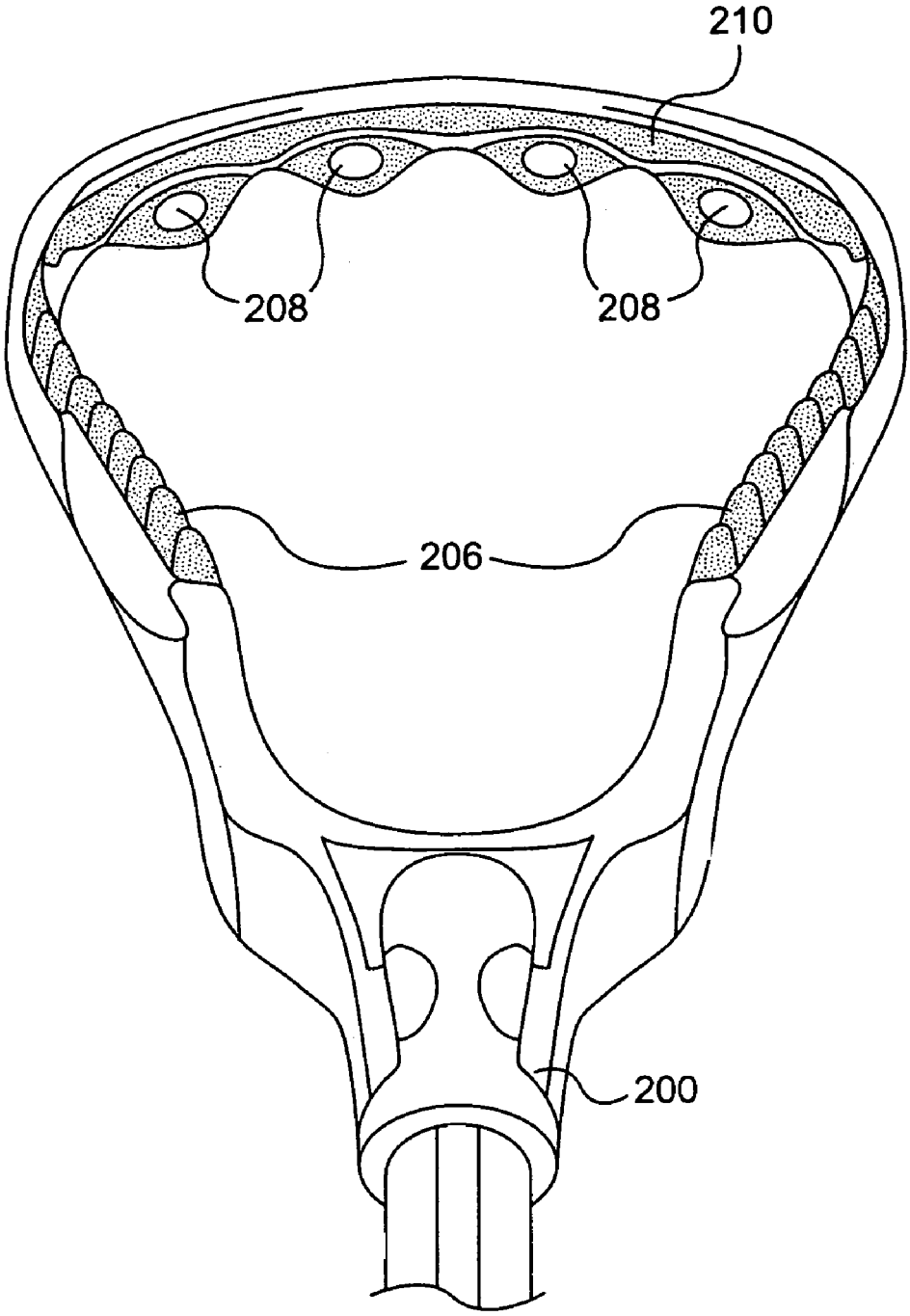
Figure 7:
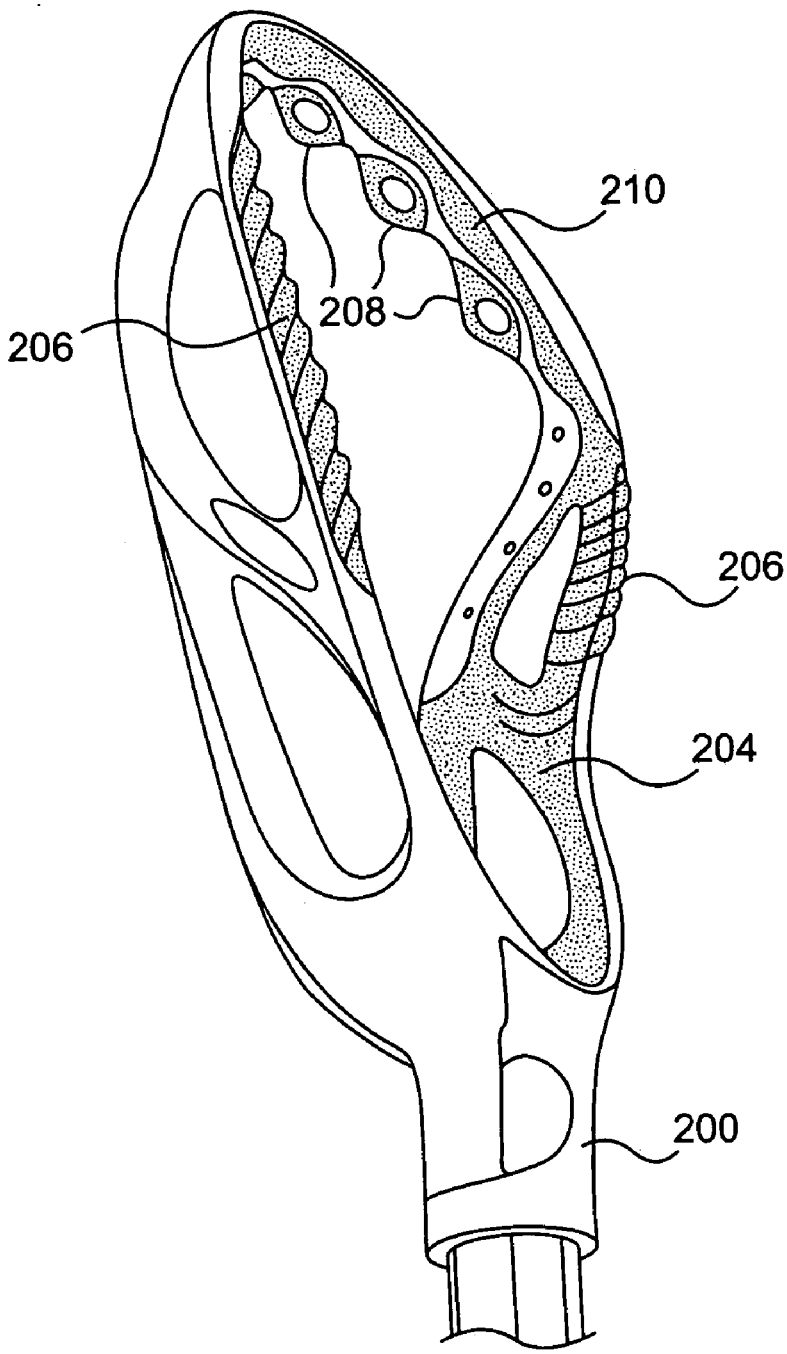

FIG. 3 illustrates a top isometric view of a base lacrosse head structure 200, showing ball stop overlay 202, sidewall overlay 204, edge overlays 206, thread opening overlays 208, and scoop overlay 210. FIG. 4 illustrates a side view of a base lacrosse head 200, showing ball stop overlay 202, sidewall overlay 204, and edge overlays 206. FIG. 5 illustrates a right side isometric view of a base lacrosse head structure 200, showing ball stop overlay 202, sidewall overlay 204, edge overlays 206, thread opening overlays 208, and scoop overlay 210. FIG. 6 illustrates a top view of a base lacrosse head structure 200, showing edge overlays 206, thread opening overlays 208, and scoop overlay 210. FIG. 7 illustrates a left side isometric view of a base lacrosse head structure 200, showing sidewall overlay 204, edge overlays 206, thread opening overlays 208, and scoop overlay 210.

The base lacrosse head structure is preferably made of a single material that satisfies the rigidity and flexibility requirements of the player and serves as the structure on which the remaining components are strategically placed to provide particular performance characteristics. The remaining components are preferably affixed to the base lacrosse head structure by, for example, insert molding, over molding, reaction injection molding, spray application, rotational molding, dual extrusion, casting, or an interference fit.

Base lacrosse head structure 200 is constructed of a durable synthetic material that provides overall structural rigidity. Examples of suitable materials for base lacrosse head structure 200 include nylon, urethane, polycarbonate, polyethylene, polypropylene, polyketone, polybutylene terephalate, acetals (e.g., Delrin™ by DuPont), acrylonitrile-butadiene-styrene (ABS), acrylic, and acrylic-styrene-acrylonitrile (ASA). The material is provisioned with recesses, cavities, depressions, or openings to which the remaining components made of different materials are affixed by, for example, insert molding, over molding, reaction injection molding, spray application, rotational molding, dual extrusion, casting, or an interference fit. The remaining component overlays are made of materials complementary to the material of base lacrosse head structure 200, such that each component strongly bonds to base lacrosse head structure 200, preferably without the use of adhesives or other intermediate bonding layers.

Examples of suitable overlay materials include urethanes (TPU), alcryln (partially crosslinked halogenated polyolefin alloy), styrene-butadiene-styrene, styrene-ethylene-butylene styrene, thermoplastic olefinic (TPO), thermoplastic vulcanizate (TPV) ethylene-propylene rubber (EPDM), and flexible polyvinyl chloride (PVC). Specifically, for a nylon base lacrosse head structure, examples of preferable overlay materials include Santoprene™, styrene-butadiene-styrene, styrene-ethylene-butylene-styrene, and alcryn. For a polycarbonate base lacrosse head structure, an example of a preferable overlay material includes alcryn (partially crosslinked halogenated polyolefin alloy). Finally, for a polypropylene base lacrosse head structure, examples of preferable overlay materials include styrene-ethylene-butylene-styrene and thermoplastic vulcanizate (TPV).

Figure 2C:
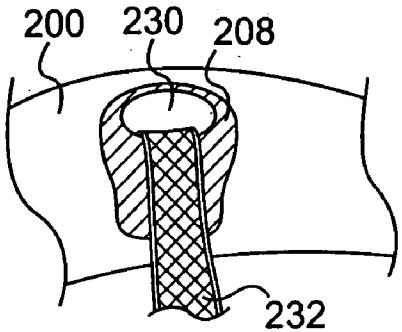
FIG. 2*c* is a schematic diagram of an exemplary thread opening overlay applied in the area of a thread opening, according to an embodiment of the present invention.
Figure 2D:
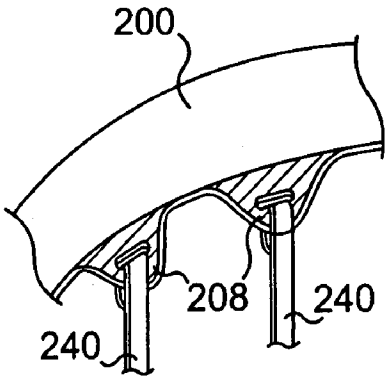
FIG. 2*d* is a schematic diagram of an exemplary thread opening overlay affixed to a base lacrosse head structure as a tab, according to an embodiment of the present invention.
Figure 2B:
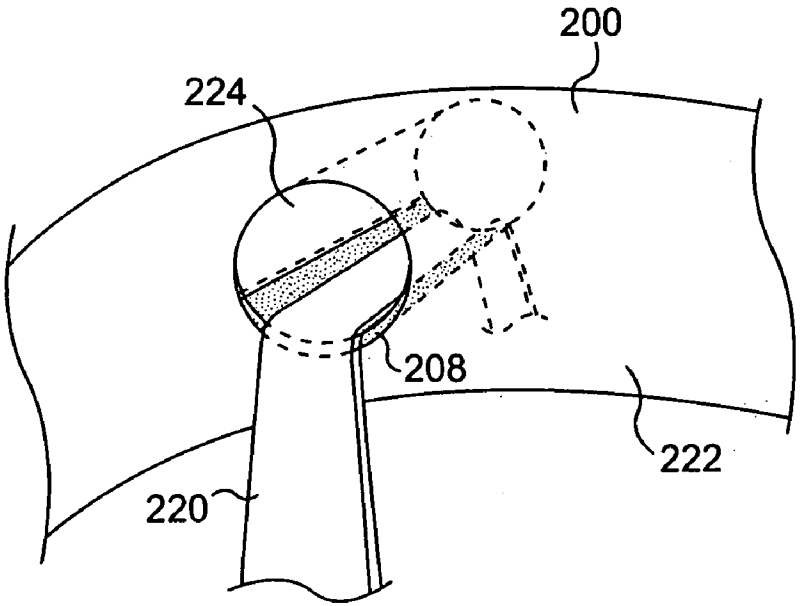
FIG. 2*b* is a schematic diagram of an exemplary thread opening overlay applied inside a thread opening, according to an embodiment of the present invention.
Figure 2E:
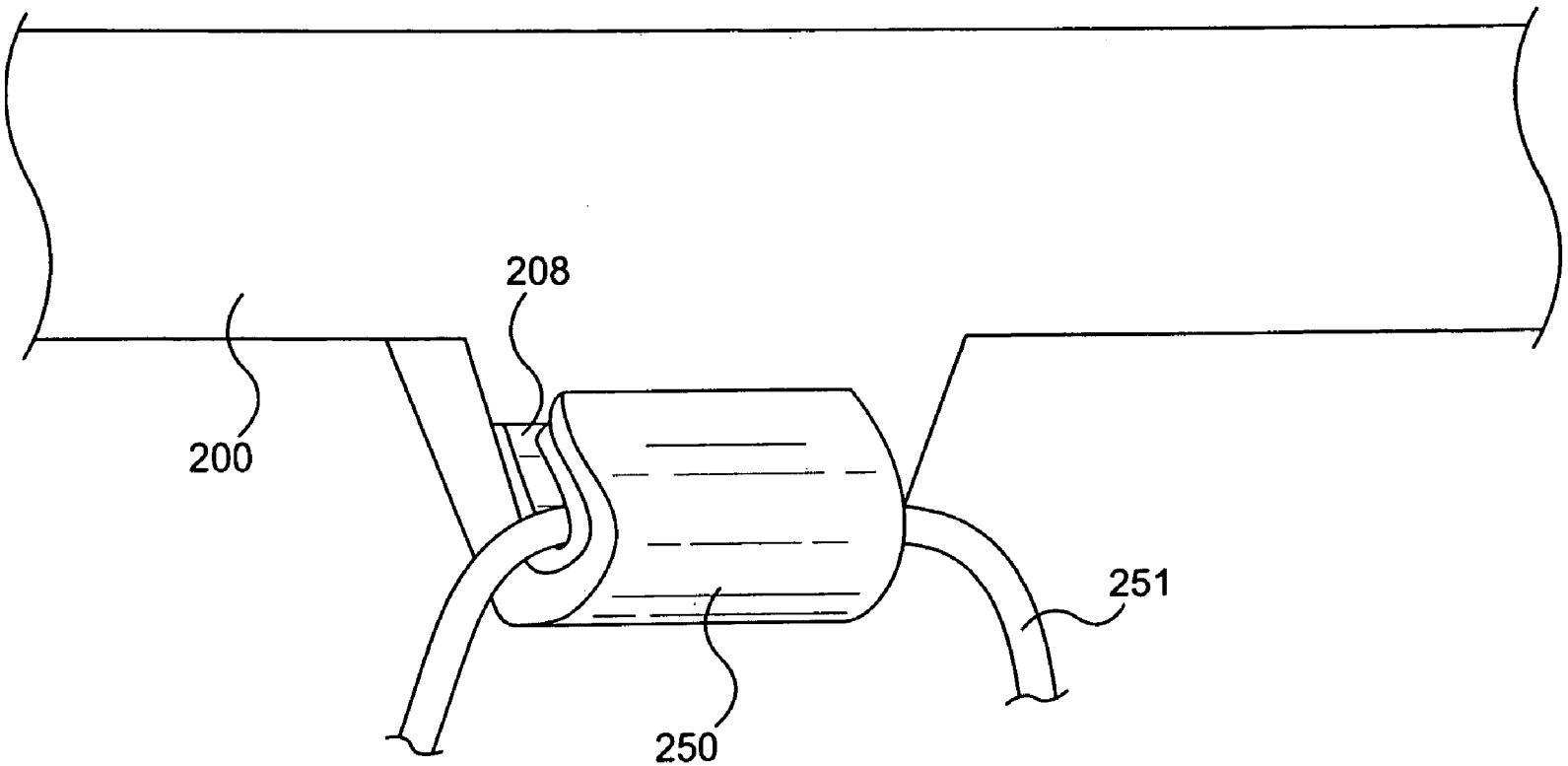
FIG. 2*e* is a schematic diagram of an exemplary thread opening overlay applied to a thread opening provided by a hook-shaped tab, according to an embodiment of the present invention.

Depending on the desired performance characteristics of each component overlay, the overlays can be made of the same or different materials, including the same or different elastomers. Although each overlay material may offer different performance characteristics, all overlay materials preferably share the property of strongly bonding to the material of base lacrosse head structure 200. Optionally, the bond between the overlays and the base material maybe mechanical in the sense of an elastomer molded into or forced into plastic openings rather than just on the surface of the base lacrosse head structure 200. For example, as shown in FIG. 2*h,* a pre-molded overlay 270 could be inserted into a recess or opening 272 (e.g., dovetail slots) in the base lacrosse head structure 200 and held in place by an interference fit.

Ball stop overlay 202 is formed on the ball stop of base lacrosse head structure 200. Ball stop overlay 202 provides a cushioning area that enhances ball control, especially while catching and cradling. The material of ball stop overlay 202 is impact-absorbing material, does not readily deteriorate, and is not easily altered to facilitate the wedging of balls behind ball stop overlay 202 in the pocket. In this manner, the manufacturer forms ball stop overlay 202 immediately after forming base lacrosse head structure 200 and avoids the effort and expense associated with procuring and affixing a foam ball stop on the lacrosse head. Further, ball stop overlay 202, as a durable integral component of the lacrosse head, lasts the life of the head, and does not deteriorate and require replacement. In an embodiment of the present invention, ball stop overlay 202 includes ridges that help absorb the impact of the ball and keep the ball under control within the pocket.

Sidewall overlays 204 provide both shock absorption and a high coefficient of friction between the inside face of a sidewall and a lacrosse ball. The shock absorption deadens impacts from balls, thereby limiting rebound within the pocket and improving ball control. The increased friction (as compared to the friction between the base lacrosse head structure and the ball) provides a better feel for the contact between the lacrosse head and ball, enhancing a player's ball control in executing such skills as receiving a thrown ball and cradling and protecting the ball in the pocket. Suitable materials for sidewall overlays 204 include soft and pliable materials such as elastomers and rubber. Although such materials lack the rigidity to function as the sole material of the sidewalls, the multi-component heads of the present invention allow the use of different materials in strategic locations to satisfy the disparate goals of rigidity and ball control (by increased friction and shock absorbing).

FIG. 2*a* illustrates only a representative portion of sidewall overlay 204. Depending on the desired performance characteristics, sidewall overlay 204 could extend up to the entire length of the inside face of the sidewalls, from the stop member to the scoop. On a lacrosse head with a scoop overlay and ball stop overlay, having a full-length sidewall overlay would create a continuous overlay around the lacrosse head.

Figure 8B:
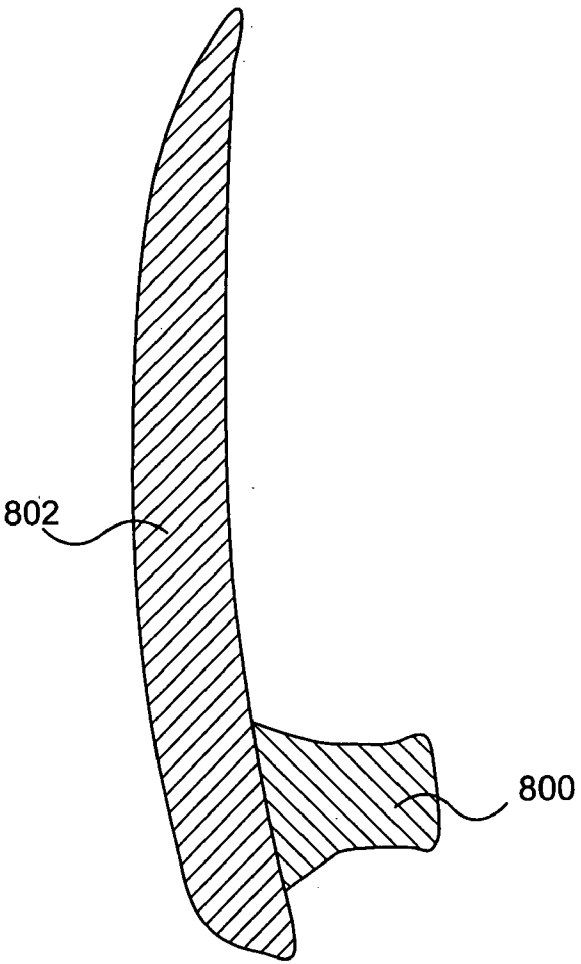
FIG. 8*b* is a schematic diagram of a cross-sectional view of the sidewall overlay of FIG. 8*a* along line 8*b*–8*b*.
Figure 8A:
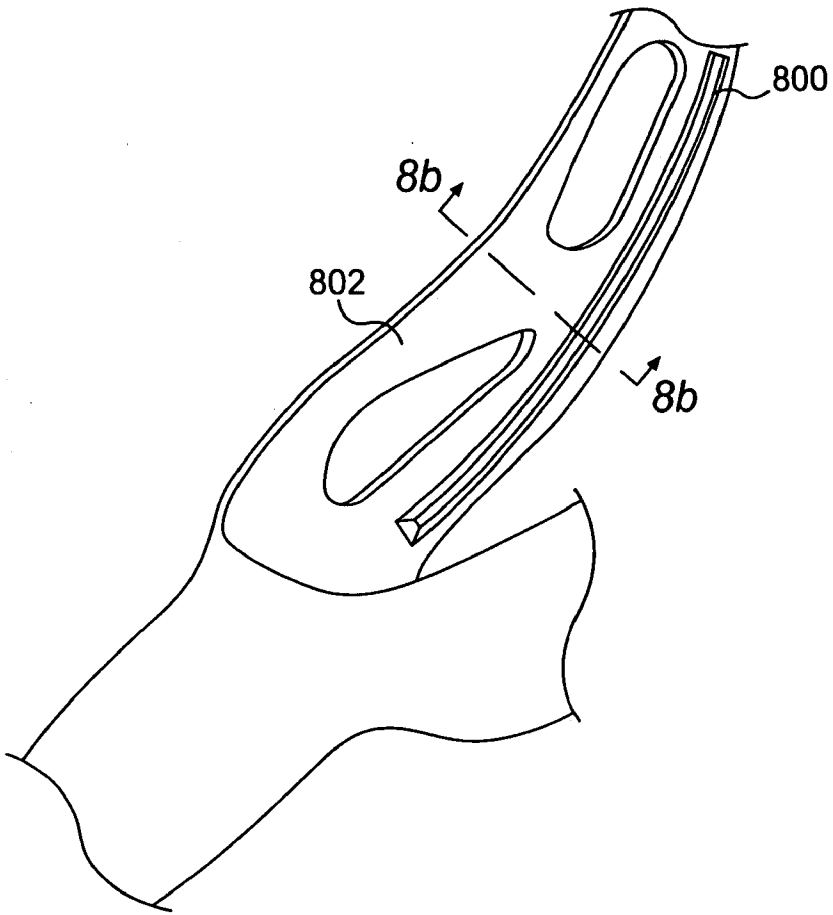
FIG. 8*a* is a schematic diagram of an exemplary sidewall overlay, according to an embodiment of the present invention.

As a further embodiment of a sidewall overlay, FIG. 8*a* shows a sidewall overlay 800 that includes a rib protruding from the sidewall 802. FIG. 8*b* illustrates a cross-section of the rib sidewall overlay 800 and sidewall 802. The rib of sidewall overlay 800 is preferably made of a compressible, impact-absorbing material that reduces rattle of the ball within the pocket. The shape and location of rib sidewall overlay 800 direct the ball toward the center or "sweet spot" of the pocket. To provide the desired impact-absorbing properties, rib sidewall overlay 800 can be made of a thermoplastic elastomer, such as Santoprene™.

Figure 8D:
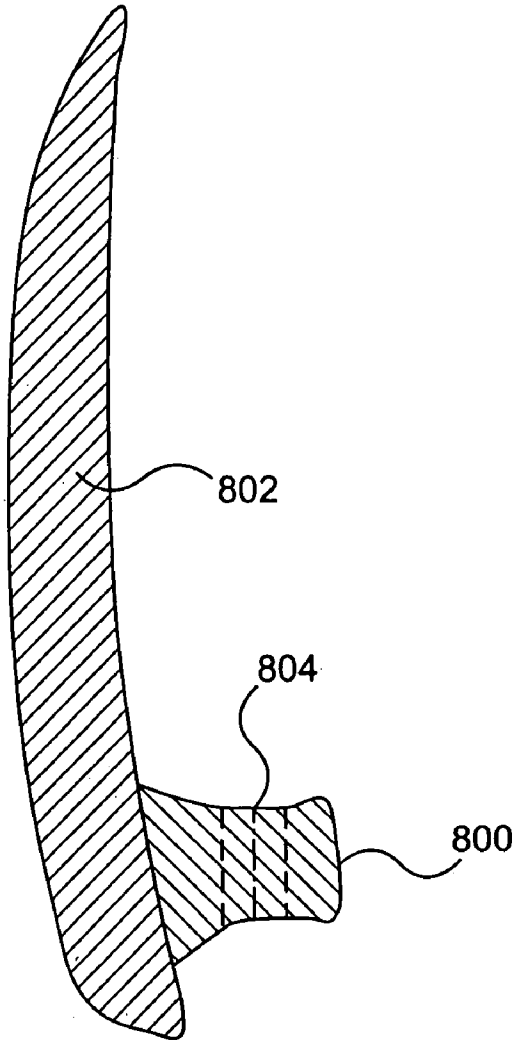
FIG. 8*d* is a schematic diagram of the cross-sectional view of FIG. 8*b*, shown with a thread opening penetrating the sidewall overlay, according to an embodiment of the present invention.
Figure 8C:
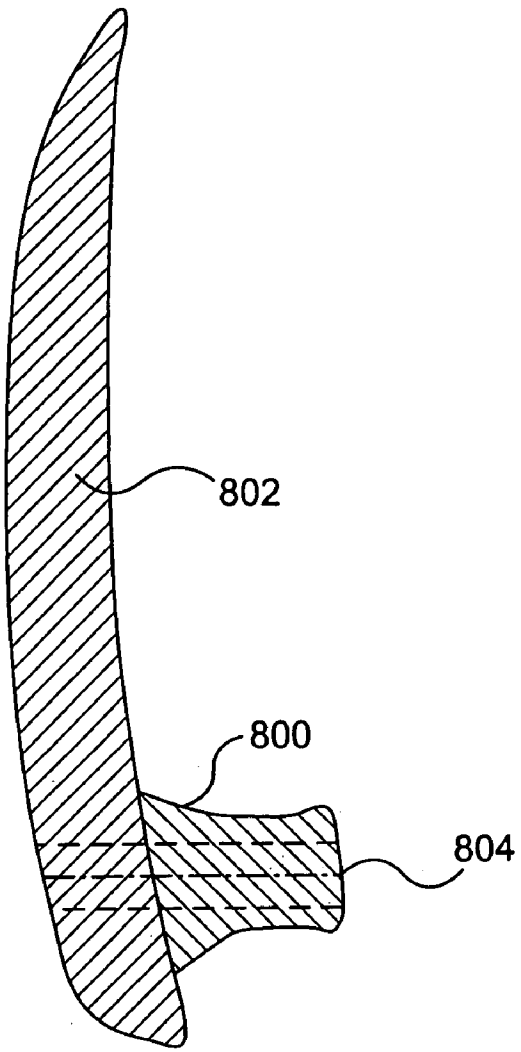
FIG. 8*c* is a schematic diagram of the cross-sectional view of FIG. 8*b*, shown with a thread opening penetrating the sidewall and sidewall overlay, according to an embodiment of the present invention.

In addition to absorbing ball impact, a further embodiment of the present invention uses rib sidewall overlay 800 to dampen the pocket of the lacrosse head, as shown in the examples of FIGS. 8*c* and 8*d*. Specifically, this embodiment places one or more threads of the pocket in contact with the flexible rib sidewall overlay 800. In the example of FIG. 8*c*, a thread opening 804 penetrates rib sidewall overlay 800 and sidewall 802 at an angle roughly perpendicular to sidewall 802. In the example of FIG. 8*d*, a thread opening 804 penetrates only rib sidewall overlay 800 (not sidewall 802) at an angle roughly parallel to sidewall 802. Of course, in addition to the exemplary configurations of FIGS. 8*c* and 8*d*, thread opening 804 could be oriented in any number of ways through sidewall 802 and/or rib sidewall overlay 800.

In any of these configurations, in response to the pull of the thread, rib sidewall overlay 800 flexes to provide a desirable "give" to the pocket, without creating an undesirable trampoline rebound effect. In other words, the material flexes to gradually stop the movement of the pocket, and then recovers gradually to its original position to avoid springing the ball out the pocket. As with impact-absorption, to provide this pocket dampening, rib sidewall overlay 800 can be made of a thermoplastic elastomer, such as Santoprene™.

Returning to FIG. 2*a*, edge overlays 206 are soft to protect players' body parts from injury. Edge overlays 206 are applied to the base lacrosse head structure at the locations most likely to contact players' bodies during normal play, such as when players stick check each other. For example, as shown in FIG. 2*a*, edge overlays 206 are applied to the top edge of the sidewalls. Although not shown in FIG. 2*a*, edge overlays 206 could also be applied to the bottom edge of the sidewalls. Thus, instead of having an entire monolithic head made of unacceptably soft material, the present invention applies soft, cushioning edge overlays where they are most needed.

As shown best in FIG. 5, an embodiment of edge overlays 206 includes ridges 500. These ridges 500 enhance ball control by directing the rebound of the ball toward the center of the pocket, while also dampening the rebound. Preferably, ridges 500 are configured and oriented to keep a ball within the pocket of the lacrosse head.

Figure 9A:
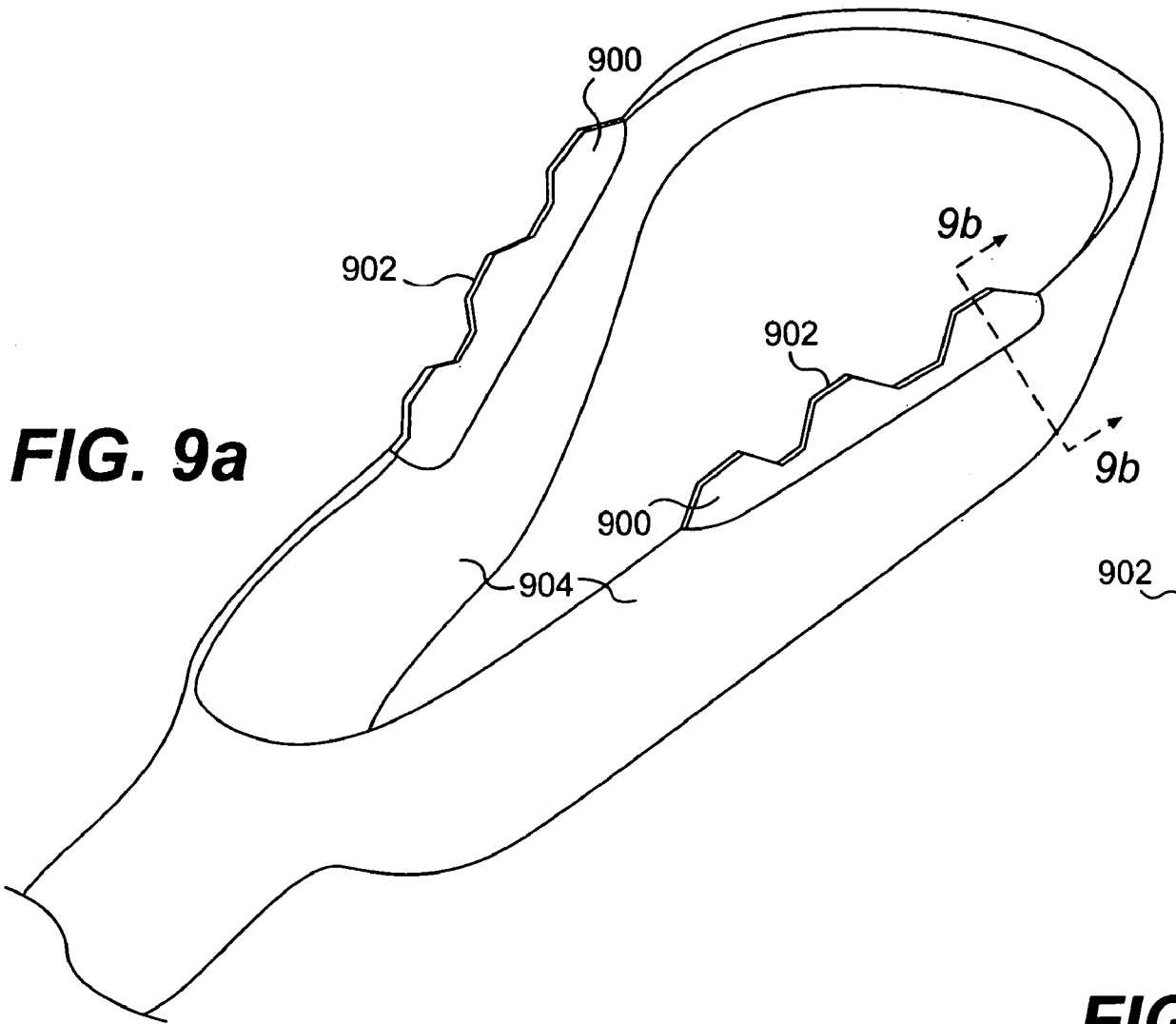
FIG. 9*a* is a schematic diagram of exemplary edge overlays, according to an embodiment of the present invention.
Figure 9B:
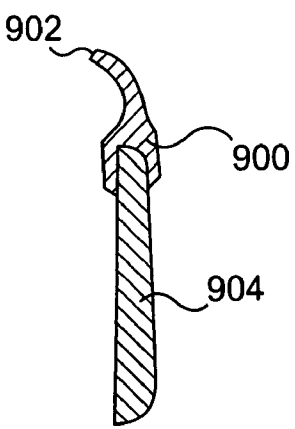
FIG. 9*b* is a schematic diagram of a cross-sectional view of an edge overlay of FIG. 9*a* along line 9*b*–9*b*.

FIG. 9*a* illustrates exemplary edge overlays 900 for achieving this effect. As shown, edge overlays 900 include large, well-defined ridges, which are referred to as teeth 902 in this example. Teeth 902 protrude from the top edge of the sidewalls 904 in an inward direction toward the center of the pocket, as shown in the cross-sectional view of FIG. 9*b* (along line 9*b*–9*b* of FIG. 9*a*). In this manner, when a ball inside the pocket contacts the top edge of sidewall 904, the protruding structure of edge overlays 902 tends to rebound the ball back inside the lacrosse head frame. This rebound into the pocket is especially helpful when a player cradles the lacrosse stick, which causes the ball to swing from sidewall to sidewall. As the ball swings back and forth, the protruding edge overlays 902 help keep the ball within the pocket. Thus, this embodiment affords greater control of the ball, by both dampening the movement of the ball and directing the movement of the ball toward the center of the pocket.

Returning again to FIG. 2*a*, thread opening overlays 208 contact the strings or thongs as they penetrate the scoop, sidewalls, or stop member, or tabs attached to the scoop, sidewalls, or stop member. Thread opening overlays 208 provide a compressible component against which the pocket threads can pull. Further, the material of thread opening overlays 208 has memory, such that once the thongs or strings stop pulling, thread opening overlays 208 gradually return to their previous shape. In this manner, when a ball hits the pocket and pushes against the strings and/or thongs, the strings and/or thongs pull against the thread opening overlays 208, and the material of thread opening overlays 208 compresses, dampens the impact, and gradually stops the movement of the ball. With the ball stopped and under control, the strings and/or thongs release and allow the material of thread opening overlays 208 to return to its original size and shape, ready to dampen another impact.

The dampening provided by thread opening overlays 208 eliminates the trampoline effect of the prior art and gives the lacrosse player improved ball control. Providing this dampening on a monolithic head made entirely of the overlay material would compromise the entire performance of the head, making it too soft, compressible, and flexible. In contrast, the multi-component design of the present invention provides superior performance in two respects: the head remains rigid by virtue of base lacrosse head structure 200, and the compressible thread opening overlays 208 provide a pocket that "gives" in response to ball impact and greatly improves a player's ball control.

In a preferred embodiment, thread opening overlays 208 are provisioned on at least the thread openings of the scoop. Thread opening overlays 208 compress in response to the pull of the thongs, which typically bear the majority of the load on the pocket in comparison to the other pocket threads. In an alternative embodiment, thread opening overlays 208 are applied to the thread openings of the sidewalls and stop member to dampen the overall pocket and further enhance ball control. Such a thread opening overlay configuration is suitable for both traditionally-strung and mesh pockets.

Thread opening overlays 208 can be applied to base lacrosse head structure 200 in a variety of ways, depending on the desired performance characteristics. At a minimum, the overlay material is preferably applied inside a thread opening at points where a thread contacts the thread opening. In this manner, as shown in FIG. 2*b*, thread opening overlay 208 compresses between thread 220 and base material 222 in opening 224 and provides the desired dampening. In such a configuration, thread opening 224 is preferably of a two-layered construction, in which base material 222 is identical to the material of the base lacrosse head structure 200 and the material of thread opening overlay 208 is applied over the base material, especially within the thread opening. Preferably, thread opening overlay 208 is a two-layered component that includes a base material for suspension purposes and an overlay material for abrasion resistance and dampening.

Figure 2F:
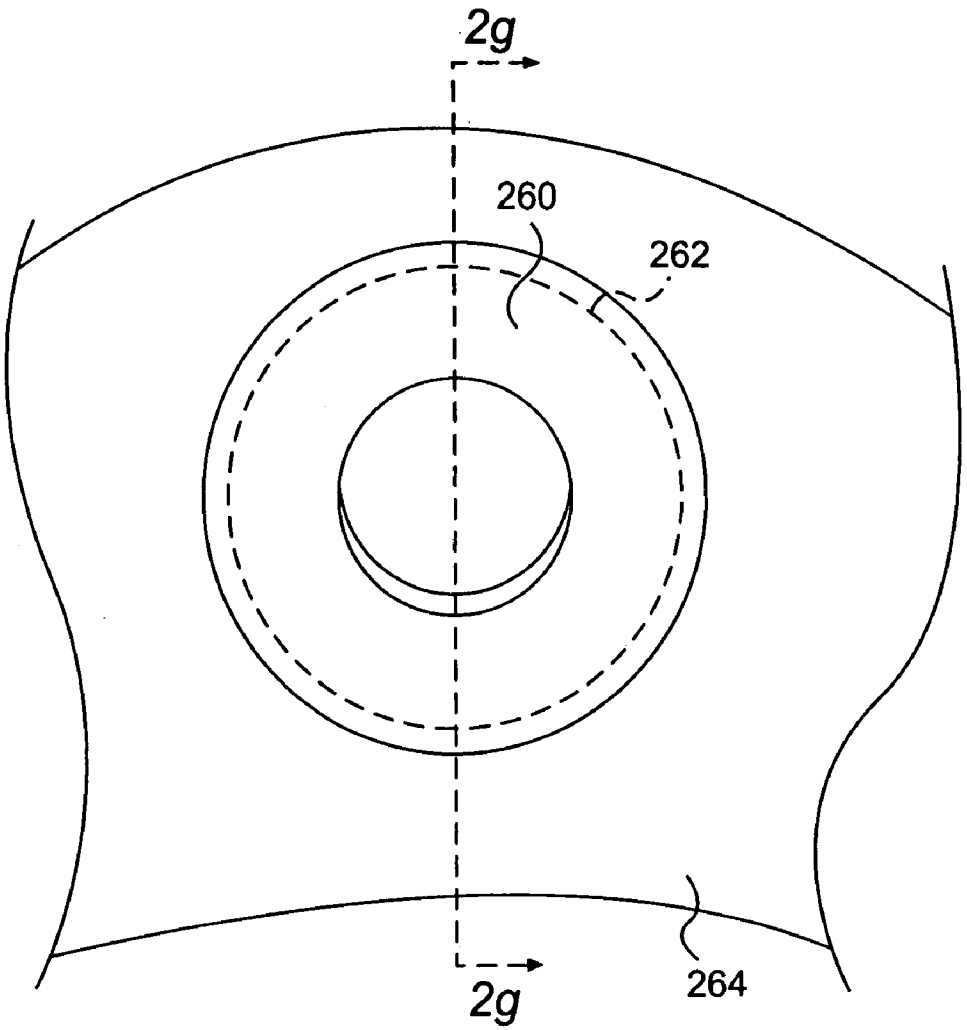
FIG. 2*f* is a schematic diagram of an exemplary thread opening overlay made of a ring of overlay material disposed within a thread opening, according to an embodiment of the present invention.
Figure 2H:
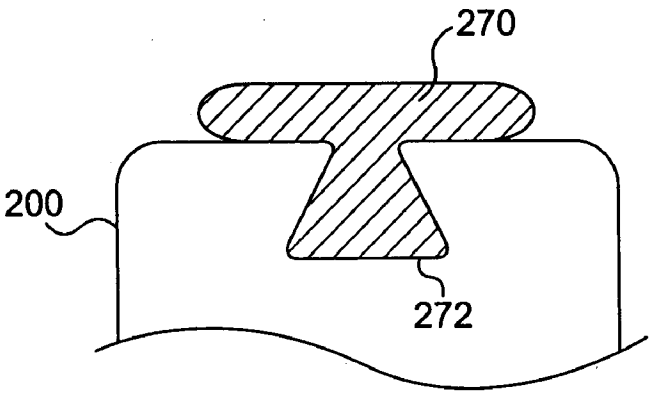
FIG. 2*h* is a schematic diagram of a pre-molded overlay inserted into a recess in a base lacrosse head structure, according to an embodiment of the present invention.
Figure 2G:
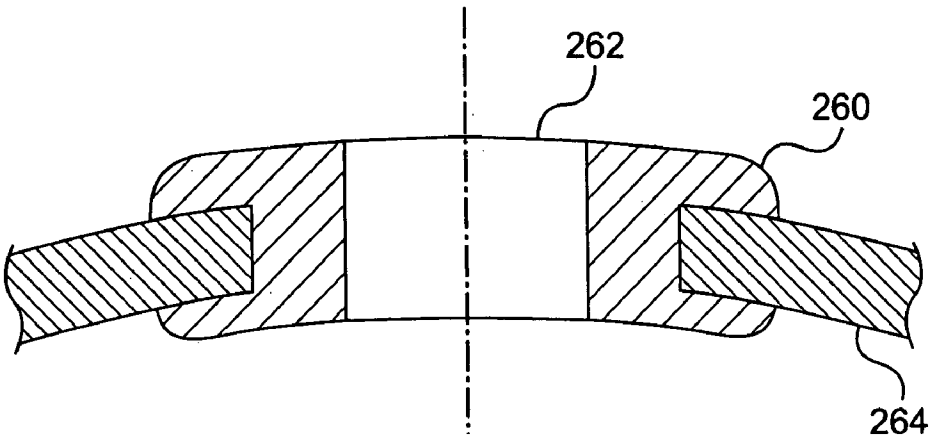
FIG. 2*g* is a schematic diagram of a cross-sectional view of the thread opening overlay of FIG. 2*f* along line 2*g*–2*g*.

As a further embodiment of the thread opening overlays, FIG. 2*f* illustrates a ring 260 of overlay material disposed within a thread opening 262. In this embodiment, ring overlay 260 provides dampening in any direction in which a thread pulls inside thread opening 262. Ring overlay 260 compresses between the thread (not shown) and the base lacrosse head structure 264. FIG. 2*g* shows a cross-sectional view of ring overlay 260 disposed within thread opening 262 of base lacrosse head structure 264.

In addition to being applied inside the thread opening, thread opening overlay 208 can be applied in the area of a thread opening where the threads are likely to lay or rub during use of the lacrosse stick. For example, as shown in FIG. 2*c,* thread opening overlay 208 is applied around thread opening 230 so that thread 232 lays against and compresses thread opening overlay 208 when thread 232 is under tension (e.g., when the threads pull tightly against the lacrosse head while catching a ball).

In an alternative embodiment, thread opening overlay 208 is a tab affixed to the base lacrosse head structure 200, with a thread opening through the tab. The tab is preferably affixed to the scoop, sidewalls, or stop member of the lacrosse head and is made entirely of the overlay material. FIG. 2*d* illustrates an example of this embodiment in which thread opening overlays 208 are tabs attached to a scoop and made entirely of an overlay material. In this configuration, the entire tab "gives" against the pull of threads 240 and provides the beneficial dampening. Optionally, instead of a tab made entirely of the overlay material, the tab could be made of the material of base lacrosse head structure 200, with thread opening overlay 208 applied inside or around the thread openings in the tab as described above.

Figure 2I:
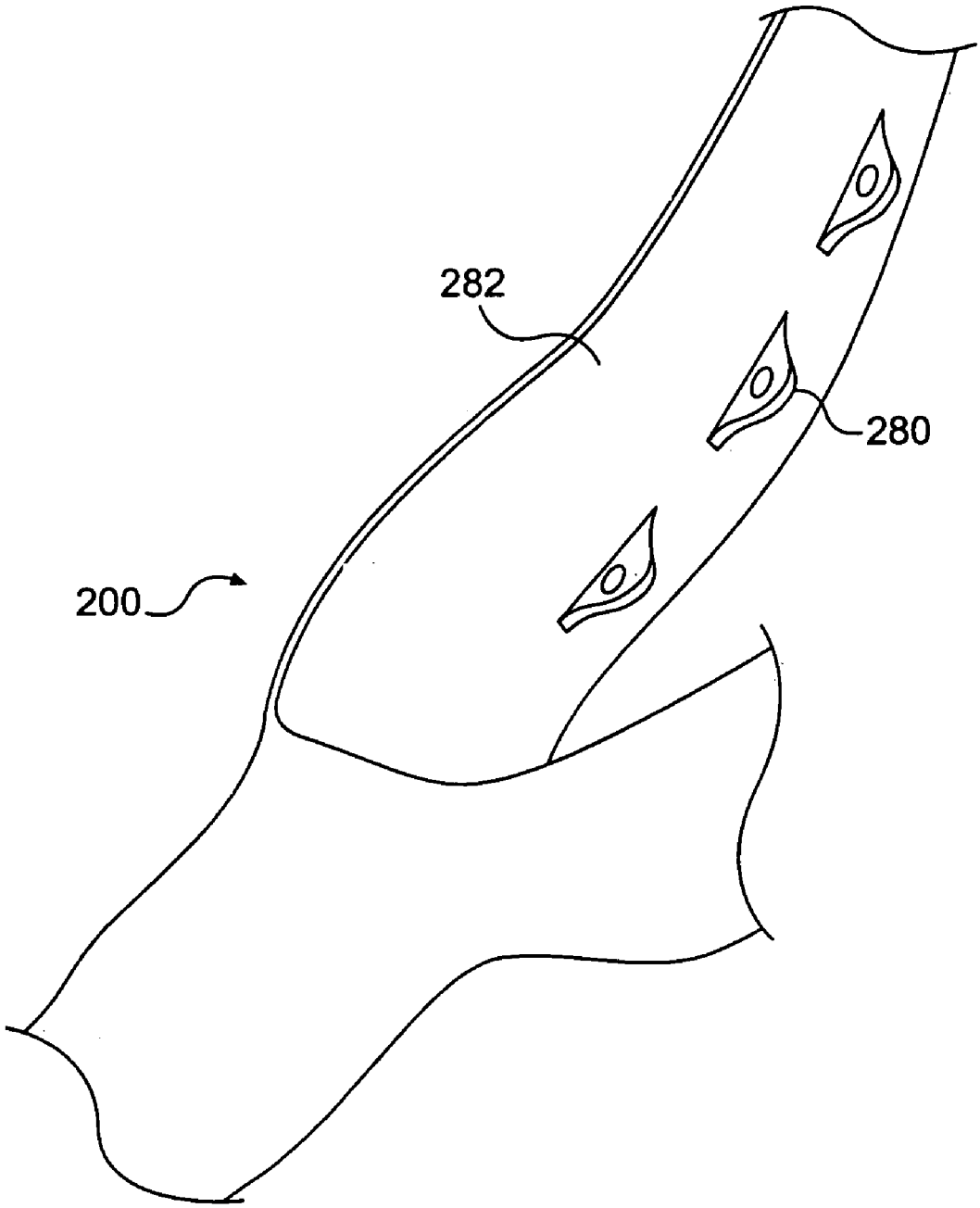
FIG. 2*i* is a schematic diagram of exemplary thread opening overlays affixed to the sidewall as tabs, according to an embodiment of the present invention.

Although FIG. 2*d* shows tabs affixed to the edge of base lacrosse head structure 200, the tabs could be affixed to any surface of structure 200. For example, tabs made entirely of the overlay material could be affixed to the inside face of a sidewall. FIG. 2*i* shows an example of this embodiment, with tabs 280 affixed to sidewall 282. As discussed above, tabs 280 could be made entirely of overlay material or could be made of the material of base lacrosse head structure 200, with overlay material applied inside or around the thread openings in the tabs 280.

As another embodiment of the present invention, FIG. 2*e* shows thread opening overlay 208 applied to a thread opening provided by a tab 250. Tab 250 is shaped as a hook, which retains a pocket thread 251. In this configuration, pocket thread 251 pulls against thread opening overlay 208, which compresses and provides the desired dampening. Although shown as covering only the inside of tab 250, thread opening overlay 208 could cover all surfaces of tab 250. Alternatively, tab 250 could itself be thread opening overlay 208, with the entire tab 250 made of overlay material.

Referring again to FIG. 2*a,* scoop overlay 210 enables a manufacturer or a player to fine tune surface friction in the area of the scoop. Scoop overlay 210 provides a high coefficient of friction between the scoop and a lacrosse ball in areas where a player desires more ball control in executing such skills as shooting and passing the ball. The coefficient of friction between the scoop and the ball is preferably greater than the coefficient of friction between the material of the base lacrosse head structure and the ball. In addition, because scoop overlay 210 is applied only to specific locations, a player avoids creating frictional surfaces on the scoop that are detrimental to stick performance. For example, a stick with a frictional surface on the underside of the scoop would catch on the ground (grass, artificial turf or otherwise) when the player is chasing ground balls and is sliding the underside of the scoop against the ground in order to scoop the ball and gain possession. Thus, unlike a monolithic head, the head of the present invention can deliver particular performance aspects at strategic locations on base lacrosse head structure 200.

The preceding descriptions of a multi-component lacrosse head are examples of embodiments of the present invention. Although the present invention is applicable to any multi-component head that satisfies divergent performance functions with two or more materials, the preceding description illustrates a multi-component lacrosse head with at least one of five distinct areas providing five distinct performance characteristics, namely: the ball stop, the inside face of the sidewalls, the top and bottom edges of the sidewalls, the thread openings, and the scoop. While the structure described herein and illustrated in the figures contains many specific examples of the use of different materials in specific locations, these uses should not be construed as limitations on the scope of the invention, but rather as examples of how the multi-component materials could be arranged to practice the invention. As would be apparent to one of ordinary skill in the art, many other variations on configuration of the base lacrosse head and overlays are possible, including differently sized and positioned components. Accordingly, the scope of the invention should be determined not by the embodiments illustrated, but by the appended claims and their equivalents.

According to one embodiment of the present invention, the process of joining the components of the present invention into a multi-component lacrosse head uses insert molding or over molding methods. Both methods produce a multi-component structure in which the components are strongly bonded such that they move in unison. Insert molding is more appropriate for multi-component lacrosse heads having continuous portions of overlays around the entire surface of base lacrosse head structure 200 and can include the complete encapsulation of the entire base material. Over molding is more suitable for overlays placed at isolated, discrete locations around base lacrosse head structure 200.

For the insert molding method, base lacrosse head structure 200 is placed inside a mold that covers the entire surface of base lacrosse head structure 200 and creates a continuous series of interior cavities between the mold and base lacrosse head structure 200. A melted thermoplastic or thermosetting elastomer is poured into the mold to fill the interior cavities. After cooling and solidifying, the material in the interior cavities forms a continuous surface of overlays.

The method for over molding is similar to insert molding except that the mold forms independent interior cavities into which melted thermoplastic or thermosetting elastomer is poured. The independent interior cavities create overlays at specific, non-continuous locations around base lacrosse head structure 200.

As an alternative embodiment of the injection molding processes described above, the process for joining the components of a multi-component lacrosse head can use a reaction injection molding (RIM) method. Reaction injection molding involves the high speed mixing of two or more reactive chemicals as the chemicals are injected into a mold. The mixture flows into the mold at a relatively low temperature, pressure, and viscosity. Curing occurs in the mold at a relatively low temperature and pressure. Reaction injection molding is also referred to as liquid reaction molding or high pressure impingement mixing.

According to another embodiment of the present invention, the process for joining the components of the multi-component lacrosse head involves spraying the overlays onto the base lacrosse head structure. The overlays can be sprayed on top of the base lacrosse head structure or within recesses, cavities, depressions, or other openings of the base lacrosse head structure. An example of a suitable method for spray application is a polyurea spray elastomer system, such as the GacoFlex RU-92 Polyurea Spray Elastomer System produced by Gaco Western Inc. of Seattle, Wash.

According to another embodiment of the present invention, a rotational molding method is used to join the components of a multi-component lacrosse head. In a rotational molding process, plastic resin is loaded into a mold, which is then heated and slowly rotated on both its vertical and horizontal axes. As the plastic resin melts under the heat, the rotational movement causes the melting resin to evenly coat every surface of the mold. The mold continues to rotate during the cooling cycle so that the parts retain an even wall thickness. Once the parts cool, they are released from the mold. The rotational speed, heating, and cooling times are all controlled throughout the process.

According to another embodiment of the present invention, a dual extrusion method is used to form the multi-component lacrosse head. In this method, a first material is fed into an extrusion die along with a second material. Thereafter, the streams merge into one extrusion made of two bonded profiles. The profiles often have different hardnesses, or "dual durometers." A variation of this method is cross-head extrusion, in which introduces a solid material (e.g., metal) into the flow of melted plastic. The solid material becomes part of the extrusion. Cross-head extrusion is typically used when the solid material cannot pass through an extrusion machine's screw and barrel.

According to another embodiment of the present invention, the process for joining the components of a multi-component lacrosse head involves a low pressure casting method. In this case, the overlays would be, for example, cast on top of the base lacrosse head structure. Of course, the base lacrosse head structure could also be cast.

According to another embodiment of the present invention, the process for joining the components of the multi-component lacrosse head involves pre-molding the overlays with protrusions that cooperate with recesses, cavities, depressions, or other openings in the base lacrosse head structure. The pre-molded overlay is forced into the opening of the base lacrosse head structure and is held in place by an interference fit or other mechanical fit. For example, an edge overlay could be molded to have a protruding wedge-shaped member (e.g., dovetail shaped), which would be forced into a correspondingly shaped opening on the top edge of the sidewall of a lacrosse head.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A lacrosse stick head comprising:

a base lacrosse head structure that includes a stop member, two sidewalls connected to the stop member, and a scoop connected to the two sidewalls opposite the stop member, the stop member, the two sidewalls, and the scoop defining a pocket area of the base lacrosse head structure, a face of one sidewall of the two sidewalls having a sidewall recess, the face facing the pocket area; and an overlay molded into the sidewall recess, the overlay covering only a first portion of the face of the one sidewall, a second portion of the face comprising exposed base lacrosse head structure.

2. The lacrosse stick head of claim 1, a second sidewall of the two sidewalls having a second sidewall recess, the lacrosse stick head further comprising a second overlay molded into the second sidewall recess, the second overlay covering only a portion of the second sidewall.

3. The lacrosse stick head of claim 1, the one sidewall having a second sidewall recess, and the lacrosse stick head further comprising a second overlay molded into the second sidewall recess, the second overlay covering another discrete portion of the one sidewall.

4. The lacrosse stick head of claim 1, the overlay protruding above the inside surface of the one sidewall.

5. The lacrosse stick head of claim 1, the overlay being flush with the inside surface of the one sidewall.

6. The lacrosse stick head of claim 1, the overlay having ridges.

7. The lacrosse stick head of claim 1, further comprising a shaft attached to the base lacrosse head structure.

8. The lacrosse stick head of claim 1, further comprising a pocket attached to the base lacrosse head structure.

9. The lacrosse stick head of claim 1, the overlay having a hardness value less than that of the base lacrosse head structure.

10. The lacrosse stick head of claim 1, the one sidewall having an upper edge disposed on a ball receiving side of the lacrosse stick head, the exposed base lacrosse head structure being disposed between the overlay and the upper edge.

11. The lacrosse stick head of claim 10, both the overlay and the base lacrosse head structure being configured to be contacted by a lacrosse ball.

12. The lacrosse stick head of claim 1, the one sidewall having an upper edge disposed on a ball receiving side of the lacrosse stick head and a lower edge disposed on a ball retaining side of the lacrosse stick head, the overlay disposed closer to the lower edge than the upper edge and protruding from the one sidewall toward the pocket area.

13. The lacrosse stick head of claim 12, the overlay shaped to direct a ball toward the ball retaining side of the lacrosse stick head.

14. A lacrosse stick head comprising:

a base lacrosse head structure comprising a stop member, a first sidewall connected to the stop member, a second sidewall connected to the stop member, and a scoop connected to the first sidewall and the second sidewall opposite to the stop member, the stop member, the first sidewall, the second sidewall, and the scoop defining a pocket area of the base lacrosse head structure, the first sidewall defining a recess in an inside face that faces the pocket area; and an overlay disposed in the recess, the overlay covering only a first portion of the inside face of the first sidewall, a second portion of the inside face of the first sidewall comprising exposed base lacrosse head structure.

15. The lacrosse stick head of claim 14, the overlay having a hardness value less than that of the base lacrosse head structure.

16. The lacrosse stick head of claim 14, the second sidewall defining a second recess, the lacrosse stick head further comprising a second overlay disposed in the second recess, the overlay covering only a portion of the second sidewall.

17. The lacrosse stick head of claim 14, a longitudinal cross-section of the recess having an opening and a base, the base being larger than the opening.

18. The lacrosse stick head of claim 14, further comprising a shaft attached to the base lacrosse head structure.

19. The lacrosse stick head of claim 14, the first sidewall having a top edge at a ball-receiving side of the lacrosse stick head and a bottom edge at a pocket side of the lacrosse stick head, the overlay being disposed closer to the top edge than the bottom edge.

20. A lacrosse stick head comprising:

a base lacrosse head structure comprising a stop member, a first sidewall connected to the stop member, a second sidewall connected to the stop member, and a scoop connected to the first sidewall and the second sidewall opposite to the stop member, the scoop having a top surface on a ball-receiving side of the lacrosse stick head and an underside surface opposite the top surface, the stop member, the first sidewall, the second sidewall, and the scoop defining a pocket area; and an overlay molded onto a face of one of the stop member, the first sidewall, the second sidewall, and the top surface of the scoop, the face facing the pocket area, and the overlay covering only a first portion of the face of the one of the stop member, the first sidewall, the second sidewall, and the top surface of the scoop, a second portion of the face comprising exposed base lacrosse head structure.

21. The lacrosse stick head of claim 20, the face of the one of the stop member, the first sidewall, the second sidewall, and the top surface of the scoop defining a recess, and the overlay being molded into the recess.

22. The lacrosse stick head of claim 20, the overlay having a hardness value less than that of the base lacrosse head structure.

23. The lacrosse stick head of claim 20, further comprising a shaft attached to the lacrosse stick head.

* * * * *